US006299061B1

(12) United States Patent
Henson

(10) Patent No.: US 6,299,061 B1
(45) Date of Patent: Oct. 9, 2001

(54) SECURITY MAILBOX

(76) Inventor: Mary L. Henson, 8426 Blossom Hill Dr., Lemon Grove, CA (US) 91945

( * ) Notice: Subject to any disclaimer, the term of this patent is extended or adjusted under 35 U.S.C. 154(b) by 0 days.

(21) Appl. No.: 09/473,087

(22) Filed: Dec. 28, 1999

(51) Int. Cl.[7] ..... B65G 11/04
(52) U.S. Cl. ..... 232/47; 232/33; 232/39
(58) Field of Search ..... 232/47, 52, 17, 232/45, 43.1, 33, 39; 248/213.2, 146

(56) References Cited

U.S. PATENT DOCUMENTS

| | | | | |
|---|---|---|---|---|
| 120,578 | * | 11/1871 | Farrington | 232/52 |
| D. 354,612 | | 1/1995 | Worden . | |
| 429,986 | * | 6/1890 | Wiegland | 232/52 |
| 441,898 | * | 12/1890 | Regester | 232/52 |
| 3,301,475 | * | 1/1967 | Clark | 232/33 |
| 3,519,198 | | 7/1970 | Benoliel . | |
| 3,802,002 | * | 4/1974 | Best | 232/33 |
| 3,854,656 | | 12/1974 | Bishop et al. . | |
| 3,880,344 | * | 4/1975 | Earle | 232/17 |
| 4,724,999 | * | 2/1988 | Fitzgerald et al. | 232/17 |
| 4,905,891 | | 3/1990 | Wildish et al. . | |
| 5,000,378 | | 3/1991 | Dorr et al. . | |
| 5,267,688 | | 12/1993 | Benefield . | |
| 5,351,883 | * | 10/1994 | Pachl | 232/17 |
| 5,526,797 | * | 6/1996 | Mann | 232/47 X |
| 5,617,993 | * | 4/1997 | Morris | 232/27 |
| 5,938,113 | * | 8/1999 | Kim | 232/47 |
| 5,979,751 | * | 11/1999 | Maddox | 232/52 |

* cited by examiner

*Primary Examiner*—B. Dayoan
*Assistant Examiner*—William L. Miller

(57) ABSTRACT

A security mailbox for preventing theft of mail from one's mailbox. The security mailbox includes a container having side walls, a top wall, front and back walls, and a bottom wall and including a compartment inside thereof, and a slot extending in the front wall near the top wall for depositing mail into the container, and an opening in a side wall thereof, and also includes a flag member pivotally mounted to the container, a door member lockingly attached over the opening, and further includes a door member being pivotally mounted inside the container proximate to the slot and having at least one door member which swingingly closes access to the compartment through the slot.

14 Claims, 3 Drawing Sheets

10
22
12
26
25
27
23
31
18
24
21
16
20
17
15

SECURITY MAILBOX

BACKGROUND OF THE INVENTION

1. Field of the Invention

The present invention relates to a mail safe mailbox and more particularly pertains to a new security mailbox for preventing theft of mail from one's mailbox.

2. Description of the Prior Art

The use of mail safe mailbox is known in the prior art. More specifically, mail safe mailbox heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,905,891; 3,519,198; 5,000,378; U.S. Pat. No. Des. 354,612; U.S. Pat. Nos. 5,267,688; and 3,854,656.

While these devices fulfill their respective, particular objectives and requirements, the aforementioned patents do not disclose a new security mailbox. The inventive device includes a container having side walls, a top wall, front and back walls, and a bottom wall and including a compartment inside thereof, and a slot extending in the front wall near the top wall for depositing mail into the container, and an opening in a side wall thereof, and also includes a flag member pivotally mounted to the container, a door member lockingly attached over the opening, and further includes a door member being pivotally mounted inside the container proximate to the slot and having at least one door member which swingingly closes access to the compartment through the slot.

In these respects, the security mailbox according to the present invention substantially departs from the conventional concepts and designs of the prior art, and in so doing provides an apparatus primarily developed for the purpose of preventing theft of mail from one's mailbox.

SUMMARY OF THE INVENTION

In view of the foregoing disadvantages inherent in the known types of mail safe mailbox now present in the prior art, the present invention provides a new security mailbox construction wherein the same can be utilized for preventing theft of mail from one's mailbox.

The general purpose of the present invention, which will be described subsequently in greater detail, is to provide a new security mailbox which has many of the advantages of the mail safe mailbox mentioned heretofore and many novel features that result in a new security mailbox which is not anticipated, rendered obvious, suggested, or even implied by any of the prior art mail safe mailbox, either alone or in any combination thereof.

To attain this, the present invention generally comprises a container having side walls, a top wall, front and back walls, and a bottom wall and including a compartment inside thereof, and a slot extending in the front wall near the top wall for depositing mail into the container, and an opening in a side wall thereof, and also includes a flag member pivotally mounted to the container, a door member lockingly attached over the opening, and further includes a door member being pivotally mounted inside the container proximate to the slot and having at least one door member which swingingly closes access to the compartment through the slot.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new security mailbox which has many of the advantages of the mail safe mailbox mentioned heretofore and many novel features that result in a new security mailbox which is not anticipated, rendered obvious, suggested, or even implied by any of the prior art mail safe mailbox, either alone or in any combination thereof.

It is another object of the present invention to provide a new security mailbox which may be easily and efficiently manufactured and marketed.

It is a further object of the present invention to provide a new security mailbox which is of a durable and reliable construction.

An even further object of the present invention is to provide a new security mailbox which is susceptible of a low cost of manufacture with regard to both materials and labor, and which accordingly is then susceptible of low prices of sale to the consuming public, thereby making such security mailbox economically available to the buying public.

Still yet another object of the present invention is to provide a new security mailbox which provides in the apparatuses and methods of the prior art some of the advantages thereof, while simultaneously overcoming some of the disadvantages normally associated therewith.

Still another object of the present invention is to provide a new security mailbox for preventing theft of mail from one's mailbox.

Yet another object of the present invention is to provide a new security mailbox which includes a container having side walls, a top wall, front and back walls, and a bottom wall and including a compartment inside thereof, and a slot extending in the front wall near the top wall for depositing mail into the container, and an opening in a side wall thereof, and also includes a flag member pivotally mounted to the container, a door member lockingly attached over the opening, and further includes a door member being pivotally mounted inside the container proximate to the slot and having at least one door member which swingingly closes access to the compartment through the slot.

Still yet another object of the present invention is to provide a new security mailbox that is easy to use and install.

Even still another object of the present invention is to provide a new security mailbox that substantially reduces the user's fear that his/her mail will be stolen especially when the user is away from home for some time.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
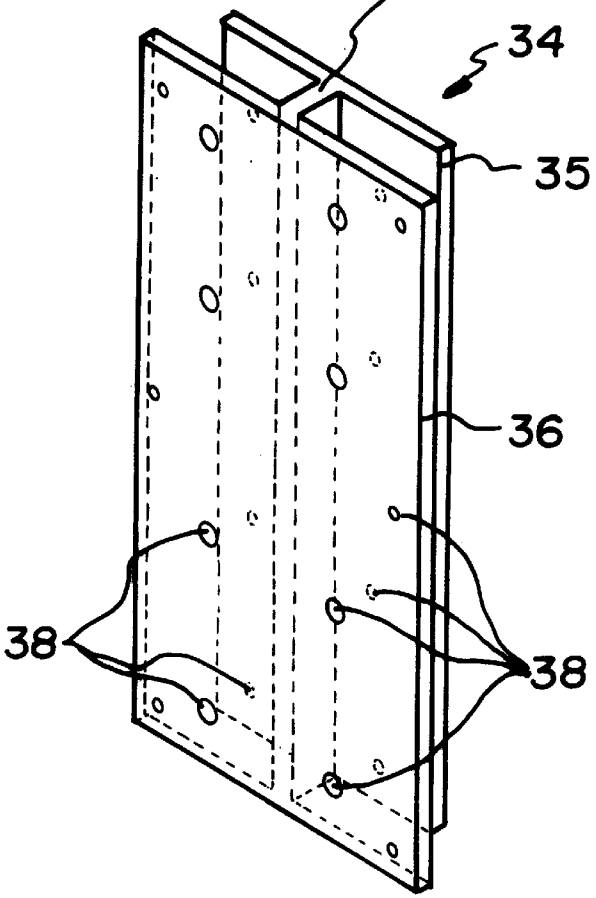
FIG. 2 is a perspective view of the mounting bracket of the present invention.
Figure 1:
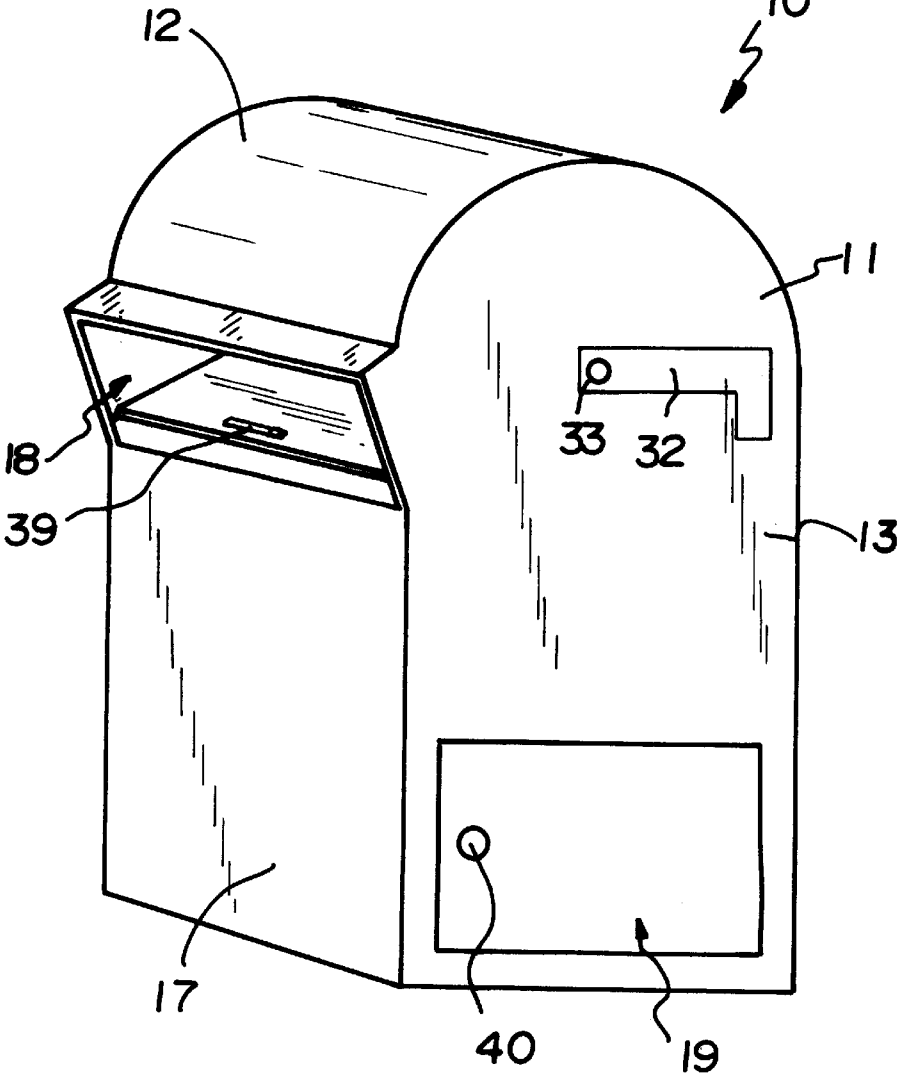
FIG. 1 is a perspective view of a container of a new security mailbox according to the present invention.
Figure 3:
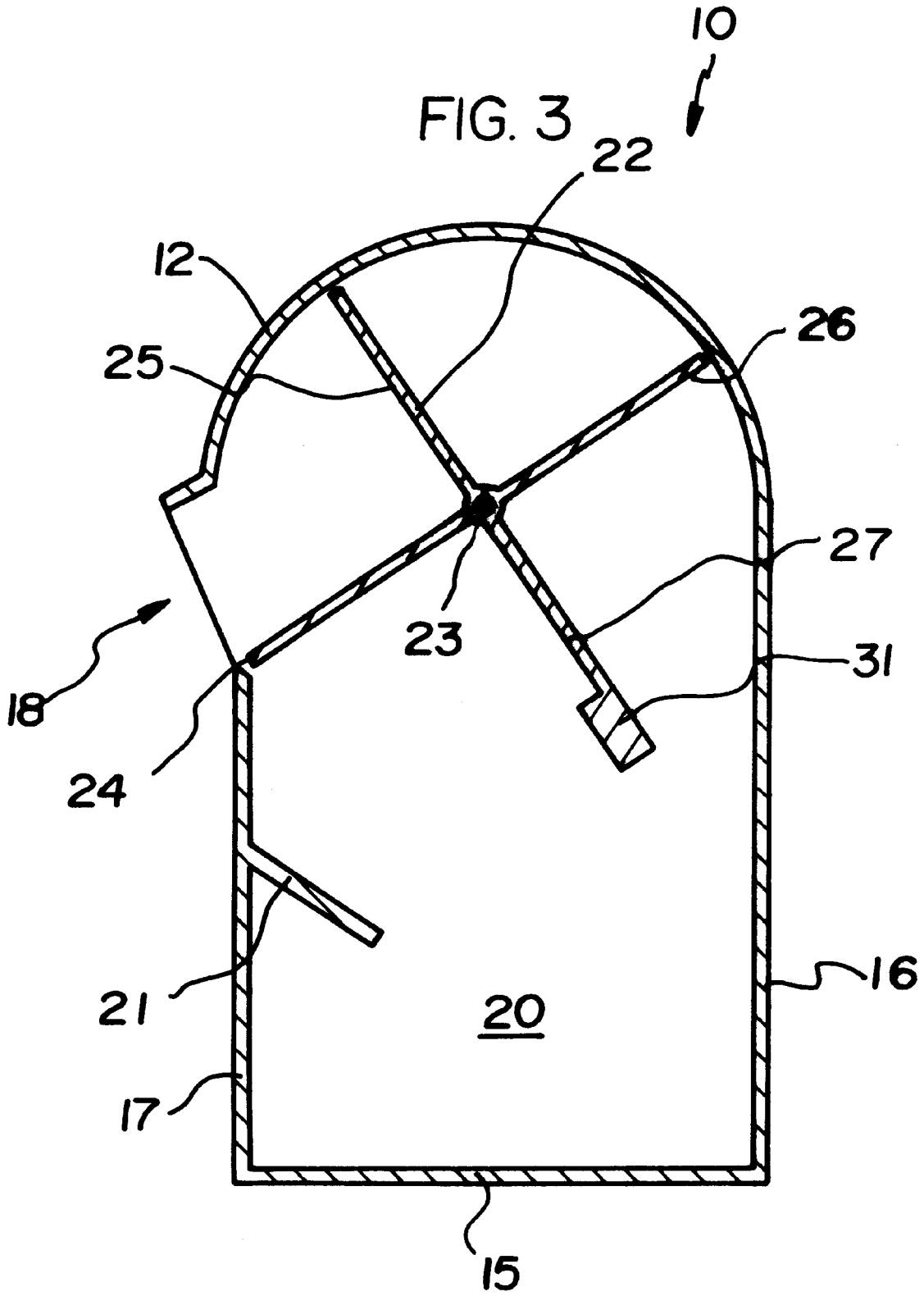
FIG. 3 is a side cross-sectional view of the first embodiment of the container of the present invention.
Figure 5:
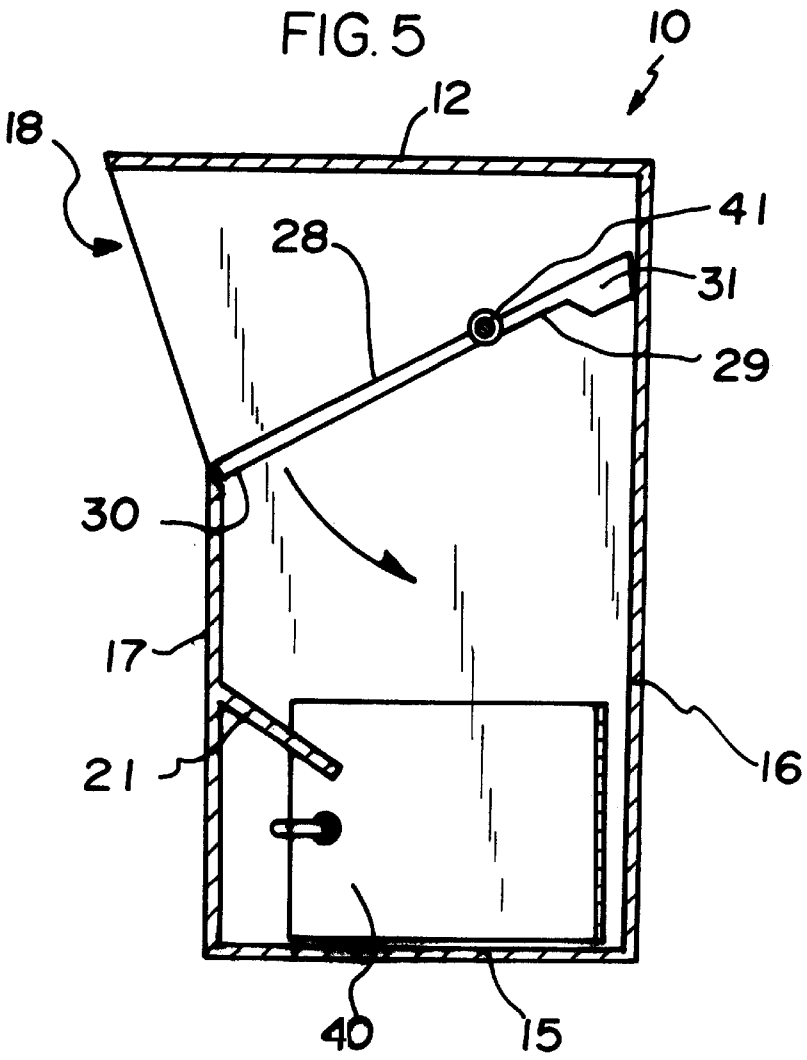
FIG. 5 is a side cross-sectional view of the second embodiment of the container of the present invention.
Figure 4:
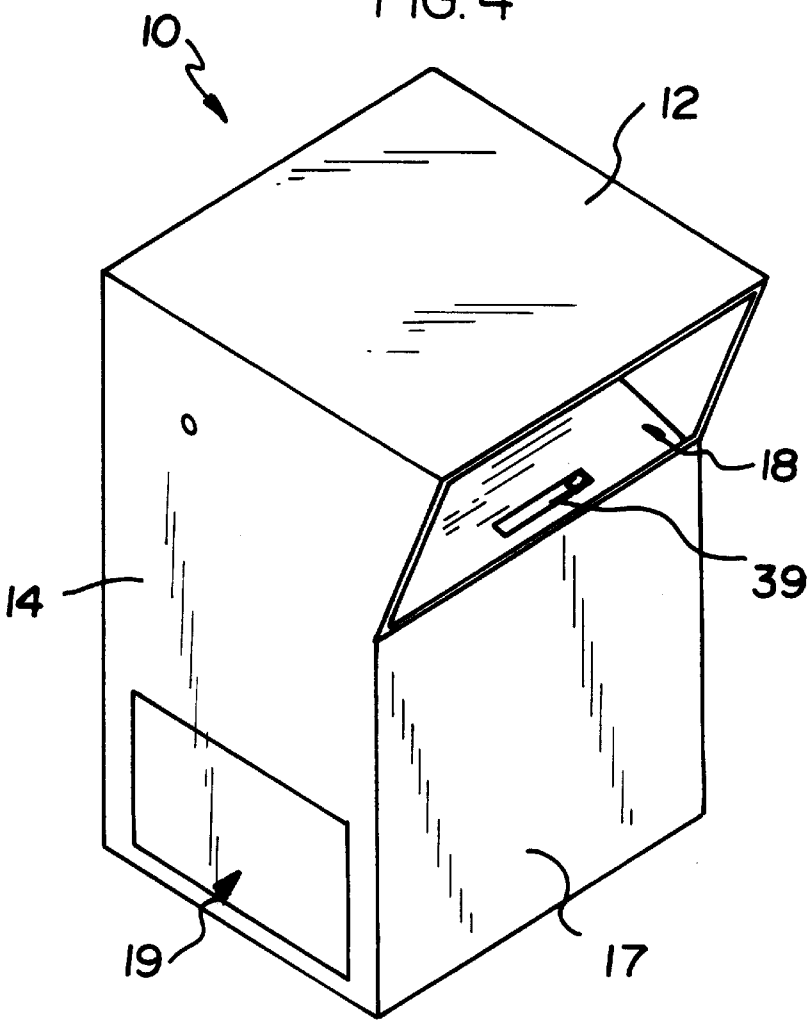
FIG. 4 is a perspective view of the container of the present invention.

With reference now to the drawings, and in particular to FIGS. 1 through 5 thereof, a new security mailbox embodying the principles and concepts of the present invention and generally designated by the reference numeral 10 will be described.

As best illustrated in FIGS. 1 through 5, the security mailbox 10 generally comprises a container 11 having a top wall 12, side walls 13,14, a front wall 17, a back end 16, and a bottom wall 15, and further having a slot 18 extending through the front wall 17 into the container 11 and having an opening 19 extending into one of the side walls 13 near the bottom wall 15 for accessing mail deposited into the container 11, and having a compartment 20 inside thereof. The container 11 further includes the top wall 12 which has a front end portion which extends forward of the front wall 17 to essentially overhang the slot 18 so that the elements of the environment cannot substantially enter the compartment 20 through the slot 18. The container 11 also includes an access blocking member 21 integrally extending from an interior of the front wall 17 and extending inwardly of the compartment 20 so that a person cannot access mail in the container 11 through the slot 18. A mail indicating member 32 is pivotally and conventionally mounted to one of the side walls 13 near the top wall 12 for indicating mail having been desposited in the container 11. The mail indicating member 32 is a flag member having an end 33 pivotally attached to the container 11. A door member 40 is lockingly closeable over the opening 19 in the container 11. The security mailbox 10 includes a means for closing access to the compartment 20 through the slot 18, and further includes a mounting bracket 34 for mounting and securing the container 11 to a structure. The mounting bracket 34 includes a back plate-like member 35, a front plate-like member 36 being spaced from the back plate-like member 35, and a cross member 37 securely and conventionally interconnecting the plate-like members 35,36 along a central portion of each of the plate-like members 35,36. The plate-like members 35,36 have a plurality of holes 38 spaced about and extending therethrough for mounting to the container 11. The security mailbox 10 also includes a spring-loaded fastening member 39 securely mounted to the door member 22,28 for removeably attaching outgoing mail thereto and being reachable by the user through the slot 18.

As a first embodiment of the security mailbox 10, the means for closing access to the compartment 11 through the slot 18 includes a revolving door member 22 conventionally mounted inside the container 11 and having a shaft 23 rotatably and conventionally mounted to the side walls 13,14 proximate to the slot 18, and further has a plurality of door members 24–27 having ends securely and conventionally attached to the shaft 23 for rotation therewith and extending radially therefrom. The door members 24–27 are adapted to close access to the compartment 11 between themselves and the front wall 17 at the slot 18, one of the door members 27 having an outer end which has a weighted member 31 securely attached thereto for placing the door members 24–27 in a closed position.

As a second embodiment of the security mailbox 10, the means for closing access to the compartment 20 through the slot 18 includes a swinging door member 28 having a pivot member 41 securely and conventionally mounted to the side walls 13,14, and includes a door member 28 having a first end 29 and a second end 30 and being securely and conventionally mounted to the pivot member 41 near the first end 29 thereof. The first end 29 has a weighted member 31 securely attached thereto for placing the door member 28 in a closed position to prevent access to the compartment 11 between the second end 30 of the door member 28 and the front wall 17.

In use, the mailman places the user's mail in through the slot 18 and upon the door member which swings downwardly from the weight of the mail thus dropping the mail inside the container 11 with the door member swinging back into a closed position. When the user wants his/her mail, the user opens the door member 40 hingedly and lockingly attached to the side wall 13 to retrieve one's mail. For outgoing mail, the user attaches the mail to the spring-loaded fastening member 39.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A security mailbox comprising:

a container having a top wall, side walls, a front wall, a back end, and a bottom wall, and further having a slot extending through said front wall into said container and having an opening extending into one of said side walls near said bottom wall for accessing mail deposited into said container, and having a compartment inside thereof;

a mail indicating member pivotally mounted to one of said side walls near said top wall for indicating mail having been disposited in said container;

a closure door member lockingly closeable over said opening in said container;

a means for closing access to said compartment through said slot; and a mounting bracket for mounting and securing said container to a structure;

wherein said mounting bracket includes a back plate member, a front plate member being spaced from said back plate member, and a cross member securely interconnecting said plate members along a central portion of each of said plate members, said plate members having a plurality of holes spaced about and extending therethrough for mounting to said container.

2. A security mailbox as described in claim 1, wherein said container further includes said top wall which has a front end portion which extends forward of said front wall to essentially overhang said slot so that the elements of the environment cannot substantially enter said compartment through said slot.

3. A security mailbox as described in claim 2, wherein said container further includes an access blocking member integrally extending from an interior of said front wall and extending inwardly inside said compartment so that a person cannot access mail in said container through said slot.

4. A security mailbox as described in claim 3, wherein said mail indicating member is a flag member having an end pivotally attached to said container.

5. A security mailbox as described in claim 4, wherein said means for closing access to said compartment through said slot includes a revolving door member mounted inside said container and having a shaft rotatably mounted to said side wall proximate to said slot, and further having a plurality of revolving door portions having ends securely attached to said shaft for rotation therewith and extending radially therefrom, said revolving door portions being adapted to close access to said compartment between themselves and said front wall at said slot, one of said revolving door portions having an outer end which has a weighted member securely attached thereto for placing said revolving door portions in a closed position.

6. A security mailbox as described in claim 4, wherein said means for closing access to said compartment through said slot includes a swinging door member having a pivot member securely mounted to said side walls, and includes a swing door portion having a first end and a second end and being securely mounted to said pivot member near said first end thereof, said first end having a weighted member securely attached thereto for placing said swinging door member in a closed position to prevent access to said compartment between said front wall and said second end of said swing door portion.

7. A security mailbox as described in claim 4, further includes a spring-loaded fastening member securely attached to said means for closing access for removeably attaching outgoing mail thereto and being reachable by a user through said slot.

8. A security mailbox comprising:

a container having a top wall, side walls, a front wall, a back end, and a bottom wall, and further having a slot extending through said front wall into said container and having an opening extending into one of said side walls near said bottom wall for accessing mail deposited into said container, and having a compartment inside thereof, said container further including said top wall which has a front end portion which extends forward of said front wall to essentially overhang said slot so that the elements of the environment cannot substantially enter said compartment through said slot, said container further including an access blocking member integrally extending from an interior of said front wall and extending inwardly of said compartment so that a person cannot access mail in said container through said slot;

a mail indicating member pivotally mounted to one of said side walls near said top wall for indicating mail having been disposited in said container, said mail indicating member being a flag member having an end pivotally attached to said container;

a closure door member lockingly closeable over said opening in said container;

a spring-loaded fastening member securely attached to said closure door member for removeably attaching outgoing mail thereto and being reachable by a user through said slot;

a means for closing access to said compartment through said slot; and a mounting bracket for mounting and securing said container to a structure, said mounting bracket including a back plate member, a front plate member being spaced from said back plate member, and a cross member securely interconnecting said plate members along a central portion of each of said plate members, said plate members having a plurality of holes spaced about and extending therethrough for mounting to said container.

9. A security mailbox as described in claim 8, wherein said means for closing access to said compartment through said slot includes a revolving door member mounted inside said container and having a shaft rotatably mounted to said side wall proximate to said slot, and further having a plurality of revolving door portions having ends securely attached to said shaft for rotation therewith and extending radially therefrom, said revolving door portions being adapted to close access to said compartment between themselves and said front wall at said slot, one of said revolving door portions having an outer end which has a weighted member securely attached thereto for placing said revolving door portions in a closed position.

10. A security mailbox as described in claim 8, wherein said means for closing access to said compartment through said slot includes a swinging door member having a pivot member securely mounted to said side walls, and includes a swing door portion having a first end and a second end and being securely mounted to said pivot member near said first end thereof, said first end having a weighted member securely attached thereto for placing said swing door member in a closed position to prevent access to said compartment between said front wall and said second end of said swing door member.

11. A security mailbox comprising:

a container having a top wall, side walls, a front wall, a back end, and a bottom wall, and further having a slot extending through said front wall into said container and having an opening extending into one of said side walls near said bottom wall for accessing mail deposited into said container, and having a compartment inside thereof;

a mail indicating member pivotally mounted to one of said side walls near said top wall for indicating mail having been disposited in said container;

a closure door member lockingly closeable over said opening in said container;

a means for closing access to said compartment through said slot; and a mounting bracket for mounting and securing said container to a structure;

wherein said container further includes said top wall which has a front end portion which extends forward of said front wall to essentially overhang said slot so that the elements of the environment cannot substantially enter said compartment through said slot;

wherein said container further includes an access blocking member integrally extending from an interior of said front wall and extending inwardly inside said compartment so that a person cannot access mail in said container through said slot;

wherein said mail indicating member is a flag member having an end pivotally attached to said container;

a spring-loaded fastening member securely attached to said means for closing access for removeably attaching outgoing mail thereto and being reachable by a user through said slot.

12. A security mailbox as described in claim 11, wherein said means for closing access to said compartment through said slot includes a revolving door member mounted inside said container and having a shaft rotatably mounted to said side wall proximate to said slot, and further having a plurality of revolving door portions having ends securely attached to said shaft for rotation therewith and extending radially therefrom, said revolving door portions being adapted to close access to said compartment between themselves and said front wall at said slot, one of said revolving door portions having an outer end which has a weighted member securely attached thereto for placing said revolving door portions in a closed position.

13. A security mailbox as described in claim 11, wherein said means for closing access to said compartment through said slot includes a swinging door member having a pivot member securely mounted to said side walls, and includes a swing door portion having a first end and a second end and being securely mounted to said pivot member near said first end thereof, said first end having a weighted member securely attached thereto for placing said swinging door member in a closed position to prevent access to said compartment between said front wall and said second end of said swing door portion.

14. A security mailbox as described in claim 11, wherein said mounting bracket includes a back plate member, a front plate member being spaced from said back plate member, and a cross member securely interconnecting said plate members along a central portion of each of said plate members, said plate members having a plurality of holes spaced about and extending therethrough for mounting to said container.

* * * * *

UNITED STATES PATENT AND TRADEMARK OFFICE

CERTIFICATE OF CORRECTION

PATENT NO. : 6,299,061 B1 
DATED : October 9, 2001
INVENTOR(S) : Takeshi Bando and Yoshikazu Tanaka It is certified that error appears in the above-identified patent and that said Letters Patent is hereby corrected as shown below:

Title page,
Item [73], Assignee, change "Kawanoe (JP) to -- Ehime (JP) --.

Signed and Sealed this

Thirtieth Day of July, 2002

*Attest:*

JAMES E. ROGAN
*Director of the United States Patent and Trademark Office*

*Attesting Officer*

UNITED STATES PATENT AND TRADEMARK OFFICE

CERTIFICATE OF CORRECTION

PATENT NO. : 6,299,061 B1
DATED : October 9, 2001
INVENTOR(S) : Mary L. Henson

It is certified that error appears in the above-identified patent and that said Letters Patent is hereby corrected as shown below:

This certificate supersedes Certificate of Correction issued July 30, 2002, the number was erroneously mentioned and should be vacated since no Certificate of Correction was granted.

Signed and Sealed this

Tenth Day of December, 2002

JAMES E. ROGAN
*Director of the United States Patent and Trademark Office*